US005119395A

United States Patent [19]

Hemsath et al.

[11] Patent Number: 5,119,395

[45] Date of Patent: Jun. 2, 1992

[54] INTERLOCK FEED-THROUGH AND INSULATOR ARRANGEMENT FOR PLASMA ARC INDUSTRIAL HEAT TREAT FURNACES

[75] Inventors: Klaus H. Hemsath, Toledo; James E. Lyon, Perrysburg, both of Ohio

[73] Assignee: Gas Research Institute, Chicago, Ill.

[21] Appl. No.: 611,938

[22] Filed: Nov. 9, 1990

[51] Int. Cl.[5] ..... F27D 7/06

[52] U.S. Cl. ..... 373/112; 432/242; 432/250; 432/5

[58] Field of Search ..... 373/112, 110, 111, 166, 373/167; 432/5, 6, 8, 10, 11, 242, 243, 247, 249, 250

[56] References Cited

U.S. PATENT DOCUMENTS

| | | | |
|---|---|---|---|
| 4,246,434 | 1/1981 | Gunther et al. | 13/20 |
| 4,787,844 | 11/1988 | Hemsath | 432/242 |
| 4,789,333 | 12/1988 | Hemsath | 432/176 |
| 4,840,559 | 6/1989 | Hemsath | 432/3 |
| 4,853,046 | 8/1989 | Verhoff et al. | 148/16.5 |
| 4,854,860 | 8/1989 | Hemsath | 432/5 |
| 4,854,863 | 8/1989 | Hemsath | 432/176 |

*Primary Examiner*—C. L. Albritton

*Assistant Examiner*—Tu Hoang

*Attorney, Agent, or Firm*—Body, Vickers & Daniels

[57] ABSTRACT

An industrial electrical, vacuum furnace for ion processing of work is provided with an improved feed-through interlock and insulator arrangement. A sealed interlock chamber on the furnace door is in fluid communication with the furnace's heat treat chamber. A bellows outside of the interlock chamber is in fluid communication therewith. When a vacuum is drawn in the heat treat chamber, the bellows distends into a collapsed position to provide a firmly clamped electrical connection with the feed-through which extends through the door into the interlock chamber. The feed-through is thus pinned by the bellows at one end and a V-shaped pulley guide arrangement within the furnace controls thermal distortion of the feed-through. The insulator arrangement includes a plurality of interlocking, ceramic caps or spacers which are stacked one on top of the other to define tortuous paths or gaps therebetween which prevent electrically conductive material deposited thereon during the ionizing process from establishing an electrically conductive path along which or as a result thereof an ion glow discharge or arcing or short circuiting could occur.

23 Claims, 5 Drawing Sheets 171
8A
8A 175
181
181
183

175
175
188
182
175
188
188
183

175
181
183
180
182

151
150
150B
158
150C
151
150A
71

180
175
14
14
182
180

150C
154
153
158
157

154
150A
153
157

150B
153
155
158

INTERLOCK FEED-THROUGH AND INSULATOR ARRANGEMENT FOR PLASMA ARC INDUSTRIAL HEAT TREAT FURNACES

This invention relates generally to vacuum electric industrial heat treat furnaces and more particularly to insulators and a feed-through arrangement for energizing the furnace hearth.

The invention is particularly applicable to a vacuum furnace having a thin, imperforate cylindrical shell in which a vacuum is drawn and will be described with particular reference thereto. However, the invention has broader application, specifically the feed-through interlock arrangement described herein, and can be applied to any vacuum furnace. Further, the invention can be applied to metal plating processes by vacuum deposition utilizing ion techniques.

INCORPORATION BY REFERENCE

The following patents are incorporated herein by reference so that the specification herein need not describe in detail that which is conventionally known in the art:

a) Gunther et al, U.S. Pat. No. 4,246,434;
b) Verhoff et al, U.S. Pat. No. 4,853,046; and
c) My prior U.S. Pat. Nos. 4,787,844; 4,840,559; 4,789,333; 4,854,860 and 4,854,863, all of which describe various aspects of the furnace to which the invention is applied.

BACKGROUND OF THE INVENTION

It is well known in the industrial heat treat furnace art to case harden metal workpieces by means of a process referred to as either ion processing or glow discharge technique or plasma arc heating. In the specifications herein, this technique will be simply referred to hereafter as ion processing.

In ion processing, the work to be heat treated is processed inside a vacuum vessel or electric furnace chamber which is evacuated with a mechanical pump and back filled to a partial pressure with a heat treating gas. If ion nitriding is to be performed, the gas contains ammonia and if ion carburizing is to be performed, a hydrocarbon such as methane is used. In addition, the work is generally sputtered clean initially by a hydrogen gas. In ion processing, the workpiece to be heat treated is electrically connected to the negative (cathode) terminal of an electrical power supply (either DC or AC rectified to DC) and the work is insulated from the vessel wall. The vessel wall is connected to the positive terminal (anode) of the power supply and to ground for safety reasons. When the power supply is energized, an electrical potential exists between the electrically conductive hearth with the workpieces sitting thereon and the vessel wall. The electrical potential causes the gases to ionize which then bombard the cathodic workpiece because of the vacuum (vacuum is defined herein to mean pressure less than atmospheric pressure) drawn in the vessel. As the gas ions bombard the workpiece some heat is imparted to the work (whether the plasma be viewed as cold, i.e. pulsed power supply, or not) and a glow about the workpiece occurs thus lending the process to the name "glow discharge". Heating can be caused solely by ion activity but conventional practice today is to use auxiliary heating not only to preheat the work but to bring the work to its heat treating temperature.

In the course of ion bombardment, metal sputters from the case and begins to coat the interior of the vessel. Metal is highly electrically conductive. In addition, depending on the gas used in the ion process (for example various metal plating processes ionize the gas to deposit metal onto the workpiece, i.e. germanium, boronizing, etc., or carbon from methane), such gas itself can deposit material which has a high dielectric constant. If the deposited, electrically conductive material builds up between the vessel casing and the hearth, electrical short circuiting and arcing will occur.

To avoid this problem, conventional practice follows the teaching disclosed in Gunther U.S. Pat. No. 4,246,434. Standard practice is to support a hearth by load support tubes fixed to the casing and secured to the underside of the rails. The load bearing tubes are encased within a ceramic shield to prevent the hearth rails from establishing electrical contact with the vessel casing. To prevent a buildup of electrically conductive material on the tubes, ceramic discs or spacers are provided along the tube length. The spacers establish tiny gaps which prevent the electrically conductive material produced in the ion process from establishing an electrically conductive conduit from hearth to tube.

Insofar as the feed-through is concerned (i.e. the negative terminal connection to the hearth), standard practice is disclosed in Verhoff U.S. Pat. No. 4,853,046. The power electrode extends through the furnace casing wall in an insulated manner and simply attaches to the hearth rail. The electrode can be insulated by being placed in a sheath within the vessel up to the hearth attachment point. An electrical interlock is then provided which disables the power supply so that the power supply cannot be energized until the vacuum pump is energized. This is generally regarded as a safe interlock. However, circuit failures can occur. For example, the vacuum pump could be sensed as on when a vacuum is not drawn in the furnace.

Apart from this, the prior art arrangements discussed above cannot work in the Indugas furnace design disclosed herein and in my prior patents. In my furnace a thin, imperforate shell member functions as the vacuum vessel. The shell thermally distorts. Any electrical connection requiring an opening through the shell will lead to premature shell failure. Also, any rigid connection of the hearth to fixed supports will cause the hearth to pitch and yaw and could vary the ion geometry.

SUMMARY OF THE INVENTION

Accordingly, it is a principal object of my invention to provide a feed-through for an electrical vacuum furnace which has an interlock which is positively actuated only by the physical conditions established during operation within the heat chamber of the furnace.

This object along with other features of the invention is achieved by means of a feed-through interlock apparatus for ion processing of work within an industrial furnace which includes a vacuum vessel having an opening sealingly closed by a door mounted to the vessel to define a heat chamber therein and a hearth for supporting the work in the chamber. The feed-through apparatus includes an interlock box affixed to the door having a sealed interlock housing therein which in turn defines a sealed interlock enclosure whenever the door is fully closed. An opening through the door is in fluid communication with the interlock enclosure so that the interlock enclosure in turn is in fluid communication with the heat chamber when the door is closed. An elongated tubular arrangement within the heat chamber shieldably contains an electrically conductive contact rod and the tubular arrangement is adapted to extend within the door opening and the contact rod is adapted to extend within the interlock enclosure when the door is closed. The contact rod has a bayonet contact at its one end within the interlock enclosure while an electrical connection between the furnace hearth and the contact rod is made in the heat chamber at the opposite end of the contact rod. An electrical power feed arrangement sealingly extends into the interlock housing for providing electrical power to the hearth and a bellows arrangement in fluid communication with the interlock enclosure is provided for clamping the bayonet contact with the power feed thus establishing a positive electrical connection between the power feed and the bayonet contact when the door is closed and a vacuum is drawn in the heat chamber. A positively engaged interlock is thus provided which is activated to energize the hearth only when the furnace door has been first closed and which is deactivated when the door is retracted a short distance.

In accordance with a more specific feature of the invention, the electrical power feed arrangement includes a power feed electrode which sealingly extends into the interlock enclosure and is secured to at least one of first and second longitudinally extending contact plates which are generally parallel to one another. A spring biases the contact plates away from one another to define a contact gap therebetween and the bayonet contact extends within the contact gap when the furnace door is completely closed. The bellows arrangement includes a push rod operatively connected to the spring and a bellows in fluid communication with the interlock enclosure for moving the push rod. In response to a negative pressure within the interlock enclosure the bellow moves the push rod against the bias of the spring and firmly clamps bayonet contact rigidly between the contact plates so that thermal expansion, for all practical purposes, occurs in a controlled manner within the furnace where a sliding U-shaped pulley arrangement controls thermal distortion of the contact rod while permitting differential thermal expansion to occur. More specifically, the bayonet contact cannot slide relative to the contact plates as the contact rod thermally expands towards the floating hearth while the integrity of the electrical connection is maintained.

In accordance with another specific feature of the invention, the tubular arrangement includes a first electrically non-conductive tube mounted within and extending through the door and a second smaller diameter electrically non-conductive tube within the heat chamber and having a portion thereof adapted to extend within the first tube when the door is closed. The electrically conductive contact rod has a portion thereof which extends through the second tube thus shielding contact rod disposed therein. Specifically, the end portion of the second tube in the heat chamber includes a plurality of interlocking insulated ring caps fitting within one another and over the second tube to prevent sparking, arcing and glow discharge at the tube end portion by tortuous gap paths established between the caps to prevent buildup of electrically conductive deposits on the tube thereby preventing any possibility of arcing within the interlock enclosure.

In accordance with another aspect of the invention, an industrial vacuum furnace is provided for heat treating metal workpieces by ionizing furnace atmosphere gases through an electrical potential established between the workpiece and the casing of the furnace. The furnace includes an electrical power supply for establishing a source of electrical potential and an imperforate thin walled cylindrical shell having a generally spherical closed axial end and an open end with a door for sealably closing the open end. An electrode is connected from the shell to the power supply. A hearth is positioned in the shell and a second power electrode is connected from the power supply to the frame of the hearth. The frame of the hearth has a pair of laterally spaced, longitudinally extending rails and at least one cross member securing the rails together. A pair of longitudinally spaced cradles is situated under each rail and rests on the shell. A plurality of interlocking insulating spacers stacked one on top of the other to form a column extends between each cradle and the underside of the rail for supporting the frame a spaced distance from the shell and without any support tubes between the frame and the shell. A pad positioned within each cradle between the column of spacers and the shell has an arcuate surface extending over at least a portion of the pad surface in contact with the shell so that the column of insulator spacers is maintained in general columnar alignment when the shell thermally distorts.

In accordance with yet another specific feature of the invention, the column spacers are formed of electrically non-conductive material so that the frame is insulated from the shell member and each spacer is interlocked with an adjacent spacer to define a tortuous space therebetween while permitting relative movement between adjacent spacers thus allowing the frame to float during thermal distortion of said shell. Specifically, each column spacer is a circular disk having a top surface and a bottom surface with the top surface having an annular groove of predetermined radial width formed therein and the bottom surface having an annular protrusion extending therefrom. The protrusion is aligned with the groove and slightly less in radial width while slightly greater in depth so that the spacers are stacked one on top of the other by the protrusion fitting within the groove of an adjacent spacer thereby defining discontinuous tortuous paths between spacers to prevent deposition of electrically conductive materials in quantities which permit arcing, short circuiting or glow discharge to occur.

It is thus an object of the invention to provide an electrical connection in an electrical vacuum furnace which occurs only when a physical condition (i.e. door closure or door closure and vacuum or in theory vacuum) actually exists in the furnace as contrasted to prior art arrangements which first sense a condition and are actuated in response to the sensed signal.

It is another object of the invention to provide in an electrical vacuum furnace of the type where the vacuum vessel is defined by a thin imperforate cylindrical shell, an electrical interlock connection for a feedthrough which maintains electrical continuity despite movement caused by thermal expansion and contraction of the shell.

It is yet another object of the present invention to provide in an electrical vacuum furnace an insulated floating hearth.

Still yet another feature of the invention is to provide an all purpose heat treating furnace which can operate either as a positive pressure, standard atmosphere batch furnace or a vacuum batch furnace or an ion processing furnace depending upon the needs of the commercial heat treater.

Still yet another feature of the invention is to provide improved means for shielding components in an electrical vacuum furnace from electrical conductivity.

These and other objects of the subject invention will become apparent to those skilled in the art upon a reading and understanding of the detailed description of the invention set forth below.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 8 is a side view of an insulating feed-through tube with the bottom half of FIG. 8 showing the tube in section and the top half showing the tube in its assembled form;

DETAILED DESCRIPTION OF THE PREFERRED EMBODIMENT

Figure 1:
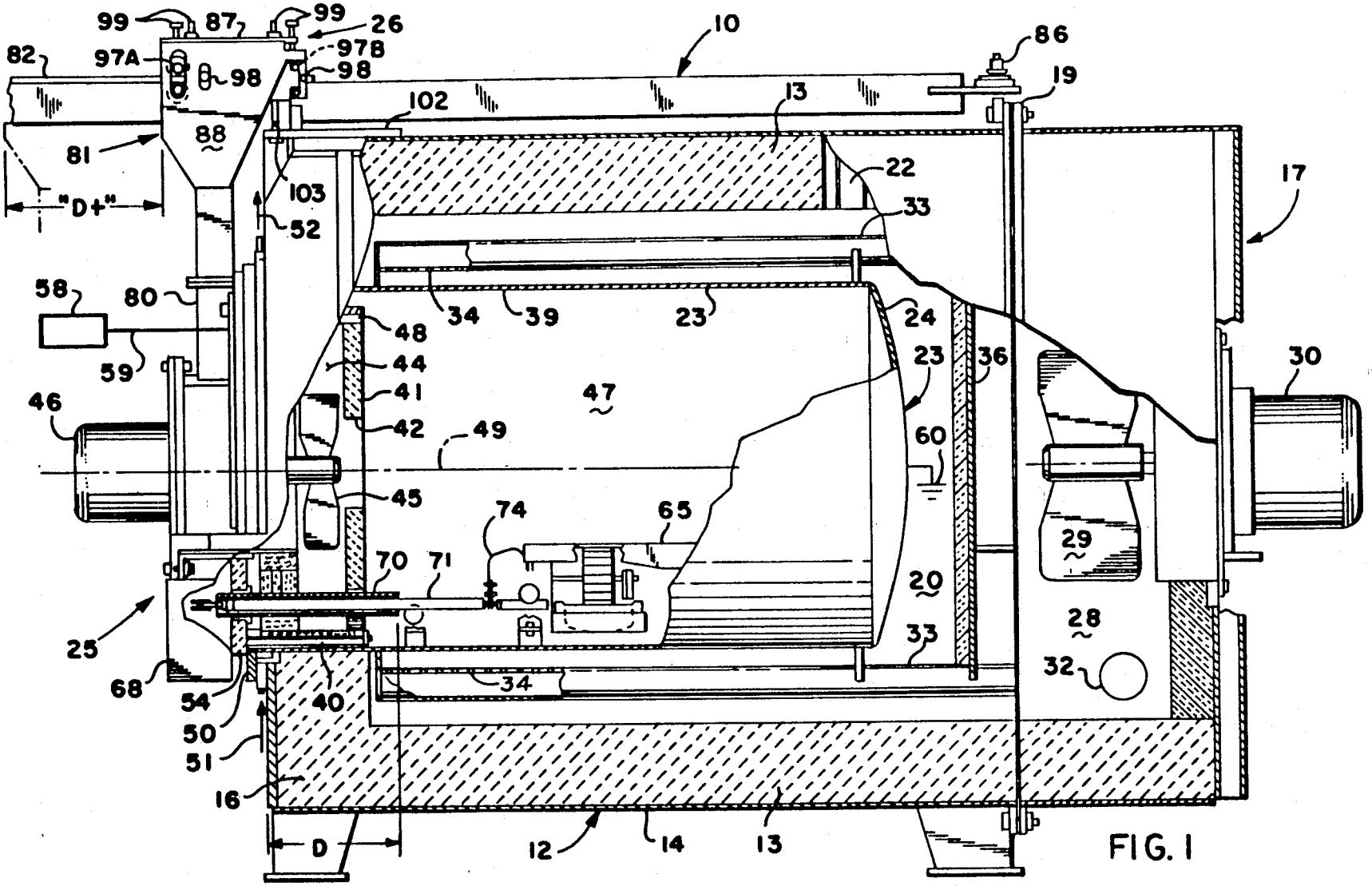
FIG. 1 is a side view of the furnace of the present invention with portions of the furnace broken away to illustrate particular interior details therein.

Referring now to the drawings wherein the showings are for the purpose of illustrating the preferred embodiment of the invention only and not for the purpose of limting the same, FIG. 1 shows a furnace 10 and corresponds somewhat to FIG. 1 of my U.S. Pat. No. 4,787,844 with FIG. 1 of the '844 patent modified to show the present invention.

Furnace 10 in general comprises a central casing section 12 which can be of any tubular cross-section configuration but preferably is circular to define a cylindrical section. Central casing section 12 is constructed in a conventional manner in that conventional, refractory type fibrous insulating material 13 is impaled on rods (not shown) secured to an exterior casing cylindrical wall 14 and held in place by buttons or fasteners (not shown). At the interior of central casing section 12, sheet metal plates (not shown) can be provided to protect the insulating material 13. Alternative construction could include a water jacket construction in lieu of factory insulation 13. However, the fibrous insulation shown is preferred to minimize cost even when furnace 10 is used as an electrical vacuum furnace.

At the forward end of central casing section 12 there is provided an insulated collar section 16 and the rearward end of central casing section 12 is closed by means of a rear block section 17. Rear block section 17 is secured to central casing section 12 by a bolted flange arrangement shown at 19. Central casing section 12, insulated collar section 16 and rear block section 17 define a furnace chamber 20 which has an opening 22 which extends to the stack (not shown). A baffle (not shown) in the stack controls the overall pressure levels within furnace chamber 20. Extending within furnace chamber 20 is an imperforate, thin-walled cylindrically shaped shell member 23. Cylindrical shell member 23 has a closed axial end 24 which preferably is spherically shaped. The opposite axial end of shell member 23 is open and is adapted to be closed by means of a door 25 and a door manipulator mechanism shown generally at 26 is provided for opening and closing door 25.

For purposes of describing the present invention, one of the functions of rear block section 17 is to supply heat to furnace chamber 20 and from there to shell member 23. In my prior patent (U.S. Ser. No. 865,839 filed May 21, 1986, now U.S. Pat. No. 4,789,333 on Dec. 6, 1988, incorporated herein by reference) an arrangement for providing heat to furnace chamber 20 is disclosed and is likewise utilized and shown in FIG. 1 hereof. Reference may be had to my prior '333 patent for a more detailed explanation than that set forth in this specification. For general disclosure purposes, an outside plenum chamber 28 is formed in rear block section 17 into which is disposed paddle blades 29 of a radial fan 30 which exhaust, under high pressure, the products of combustion from gas burners 32 (which are also in outside plenum chamber 28) through a plurality of longitudinally extending distribution tubes 33. Distribution tubes 33 extend in equally spaced radial increments and equally spaced circumferential increments about imperforate shell 23 and have a plurality of apertures or nozzles 34 formed in equally spaced increments along the length of tubes 33 and orientated to direct their jet streams of heated gas against imperforate shell 23. Insulated baffle 36 secured to rear block section 17 serves to hold distribution tubes 33 in place while preventing direct impingement of the spherical rear end 24 of shell 23 from gases emanating from plenum chamber 28. Shell member 23 is thus heated convectively by the jet streams emanating from nozzles 34 and radiantly by the heat emanating from distribution tubes 33. This arrangement can also be used to cool shell member 23. Other arrangements for heating and/or cooling shell member 23 will suggest themselves to those skilled in the art.

Shell member 23 is preferably formed of a high alloy, stainless steel such as 304L. It can have a body thickness of anywhere between ⅛" and ½" but preferred thicknesses is in the range of 0.25" to 0.375". Its cylindrical body section 39 which can vary anywhere from diameters of 24–92" is formed while being rolled to the desired diameter and sealed along its entire longitudinal length (typically 2–8 feet) by vacuum type, full penetration welds. Spherical end section 24 is preferably welded to body section 39. At the open end of shell member 24 is an annular flange 50 which abuts against collar section 16 and interspersed therebetween is a water manifold 51 with water arrows 52 indicating that water flow maintains flange 50 cool. Door 25 has a door flange 54 which seals against cold shell flange 50 by means of a conventional elastomer seal (not shown). Extending from door flange 54 is an annular shroud 40 and secured to door flange 54 and positioned at the open end of annular shroud 40 is a baffle 41 having centrally located under pressure opening 42 formed therein. Baffle 41 and shroud 40 define a plenum chamber 44 which contains a paddle bladed fan 45 driven by fan motor 46. As described in greater detail in my prior patents, an annular orificing space 48 exists between shroud 40 and baffle 41 for heat transfer purposes between furnace chamber 20 and the heat chamber 47 which is the interior of shell member 23.

Because of the thinness of shell member 23, there will be physical distortion of shell member 23 due to thermal expansion and contraction. Because of the importance of maintaining integrity of the shell, furnace connections are made through door 25. This requires that door 25 use a door opening and closing mechanism which can accurately and precisely position and seal door 25 to shell member 23. Because of shroud 40 and the feed-through tube arrangement to be described in detail hereafter, the door mechanism has to precisely permit the door to be swung or rotated from an open to a closed position whereat the door is aligned with the center of shell member 23 and then longitudinally moved along longitudinal axis 49 into its sealed position as shown in FIG. 1. This is accomplished by my door operator mechanism disclosed in my prior U.S. Pat. No. 4,787,844 and reference should be had to that patent for a more detailed description set forth herein. To maintain consistency between my prior '844 patent and the present invention, door closure mechanism 26 described herein will use the same reference numerals as used in my '844 patent.

Door manipulator 26 includes a rigid arm 80 secured at one end to door 25 and at the other end to a carriage 81. Carriage 81 rides on a rail 82 affixed to a boom 84 which pivots in a horizontal plane about a trunnion 86 mounted to flange 19 of central casing section 12. Carriage 81 essentially comprises an inverted U-shaped roller housing member 87 with the legs of the "U" (only one leg 88 shown in FIG. 1) straddling rail 82. Within U-shaped housing 87 is a second inverted U-shaped roller housing (not shown) likewise having leg walls connected by a bight wall. The side walls carry a pair of opposed rollers 97 which is adapted to contact the top and bottom surfaces of rail 82 therebetween and there is a forward and a rearward pair **97*a*, 97*b* of rollers for each of the side walls. Each pair of rollers are adjusted in a conventional manner to grip the rail therebetween (not shown) and provided with an associated eccentric 98 for maintaining housing 87 centered laterally with respect to a rail 82. Each roller pair 97 is also provided with a pair of adjusting screws 99 and are adjustable in either a vertically upward or downward direction so that door 25 can be precisely canted or cambered into proper alignment within imperforate shell member 23. The limits of travel of door 25 is determined by the length of rail 82 whereat the stop (not shown) is provided. The longitudinal travel of carriage 81 must be at least equal to the distance D shown in FIG. 1 and this travel is shown as a D+ in FIG. 1**.

The weight of door 25 and boom 84 is supported by a track 102 which carries a trolley 103. Track 102 is fixed to cylindrical wall 14 of central casing section 12 in a level manner and there are stops (not shown) associated with track 102 which permit boom 84 to pivot about trunnion 86 so that door 25 can be pivoted away from the opening in imperforate shell member 23 when work is to be loaded or unloaded from heat chamber 47. When door 25 is to be opened, carriage 81 is moved along rail 82 until shroud member 40 and a tube (to be described hereafter) clears shell member flange 50 and door 25 is then swung away from the opening in imperforate shell member 23 by trolley 103 rolling on track 102 until contacting the stop.

Furnace 10, according to the present invention, is an electrical vacuum furnace. In order for a vacuum to be pulled within imperforate shell 23, a vacuum pump schematically shown as 58 is provided through a flexible duct schematically indicated by line 59 which is sealingly secured to door 25 and communicates with heat chamber 47 through an opening (not shown) in door 25. Vacuum duct 59 is flexible and permits movement of door 25. Also through duct 59 heat treat gases can be pulled or pumped to heat chamber 47. A flexible duct and a vacuum pump are items conventionally available in the trade and do not per se form part of the invention.

In order for an electrical potential to be developed within heat chamber 47, imperforate shell 23 is grounded as at 60 in a conventional manner. Specifically and as well known in the art, shell 23 is the anode and is connected to the positive terminal of a power supply 62 (schematically illustrated in FIG. 6) and the negative terminal or power feed electrode from power supply is electrically connected to the hearth 65 in heat treat chamber 47 which functions as the cathode in the ionizing process. Power supply 62 can be a DC power source but is normally an AC to DC rectified power supply utilizing a three phase generator connected to a stepped-up transformer in turn connected to an SCR firing circuit to generate a DC pulsed current flow. An example of a power supply is disclosed in Verhoff U.S. Pat. No. 4,853,046. The power supply, the circuitry, etc., are conventional and will not be discussed or disclosed in detail herein.

Figure 3:
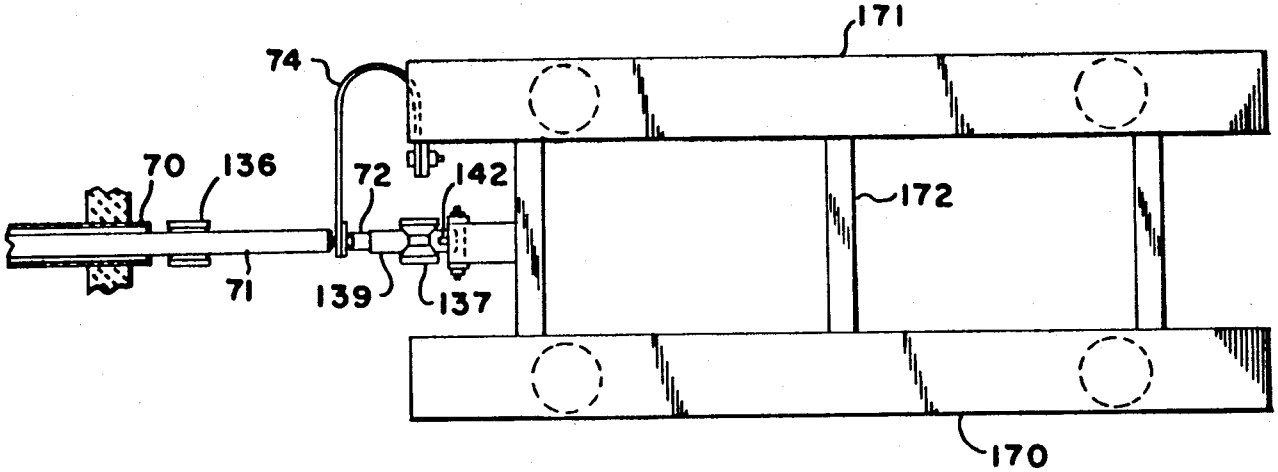
FIG. 3 is a top plan view of FIG. 2.
Figure 2:
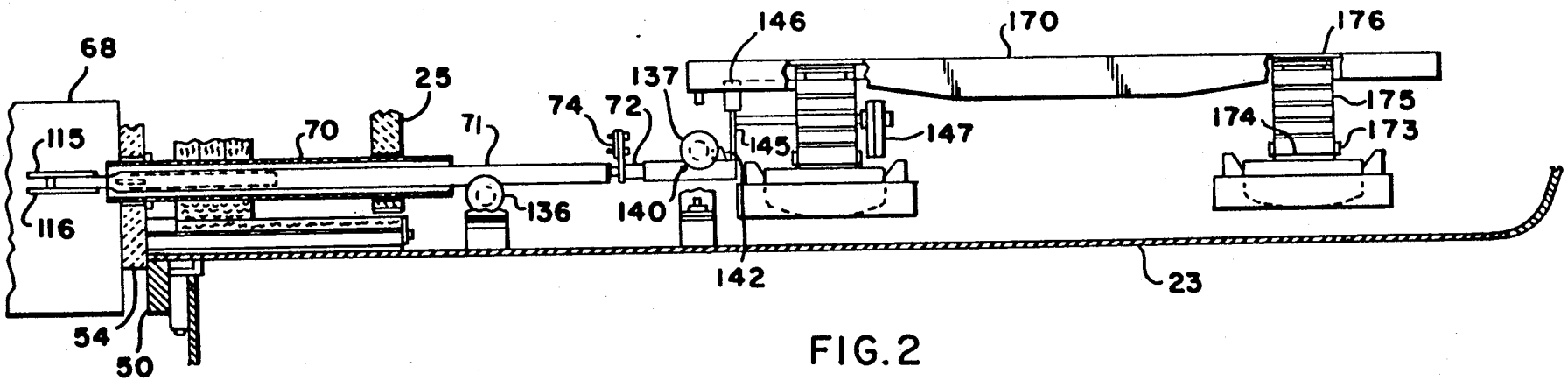
FIG. 2 is a side view of the feed-through arrangement and hearth of the present invention.
Figure 4:
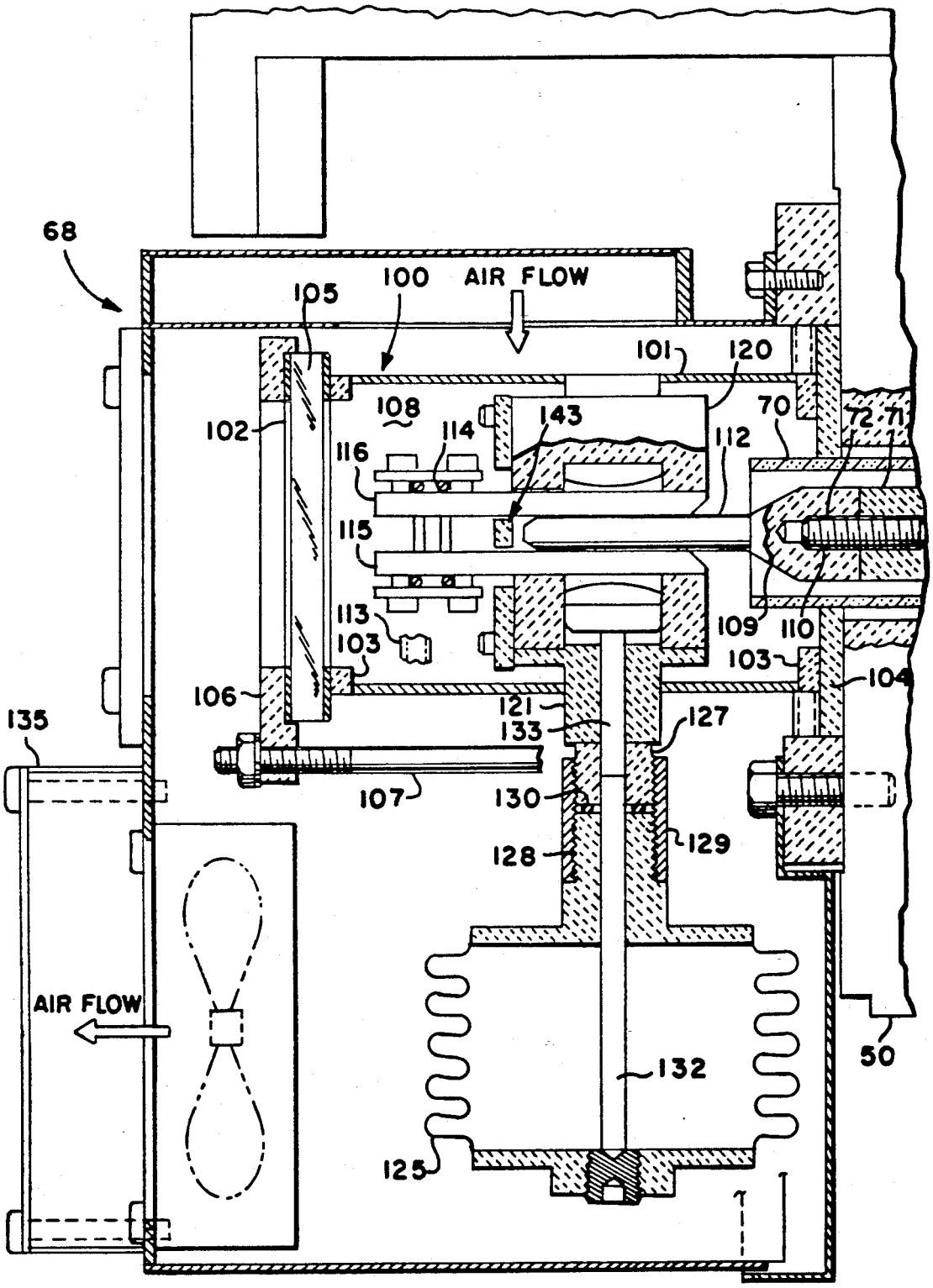
FIG. 4 is an elevation view of the feed-through interlock assembly of the present invention.

Referring now to FIGS. 1, 2 and 3, a first non-electrically conductive, ceramic tube, i.e. mullite, extends through an opening through door 25 and is sealed to an interlock box 68 affixed to door 25. Thus, first tube 70 defines a sealed opening through door 25 providing fluid communication between heat chamber 47 and interlock box 68. Disposed within first tube 70 and extending into heat chamber 47 is a second electrically non-conductive ceramic tube (mullite) 71. Extending within and through second tube 71 on both sides thereof is an electrically conductive contact rod 72 (nickel). An electrode 74 secured to the rear portion of contact rod 72 electrically connects hearth 65 with contact rod 72. As a point of reference in the preferred embodiment, first tube 70 has an inside diameter of 1½". Second tube 71 has an outside diameter of 1" and an inside diameter of ¾", and contact rod 72 has a diameter of 11/16". There is little space then between contact rod 72 and second tube 71 and, in fact, electrically conductive deposited material does not accumulate in the space to the extent where a glow discharge occurs between contact rod 72 and second tube 71.

Referring next to FIGS. 4, 5, 6 and 7, within interlock box 68 is a vacuum sealed interlock housing 100 which includes a cylindrical casing 101 which is gas tight welded to washers 103. Adjacent to the door end of casing 101 is a flat, insulating gasket 104 which seals that casing end when compressed by a ring 106 in turn secured to threaded fastener 107 secured to door flange 50. The same ring 106 also compresses window 105 and gasket 102 Parker No. N674-70 gaskets or equivalent when screws on bolts 107 are tightened. This construction provides a vacuum sealed and electronically isolated interlock enclosure or chamber 108 within interlock box 68. Extending into chamber 108 is a bayonet end 109 which is secured to one end of contact rod 72 by a rod 110 threaded into blind holes at the ends of bayonet end 109 and contact rod 72. Bayonet end 109 in turn has a flat protruding contact blade 112.

Figure 7:
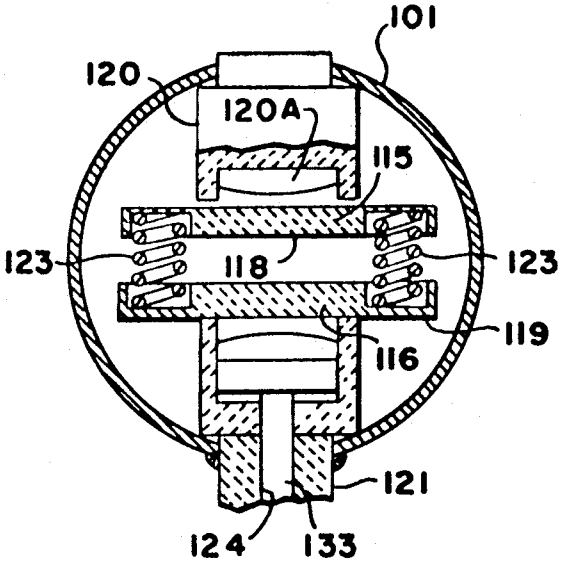
FIG. 7 is a rear side view of a portion of the interlock enclosure shown in FIG. 5.
Figure 5:
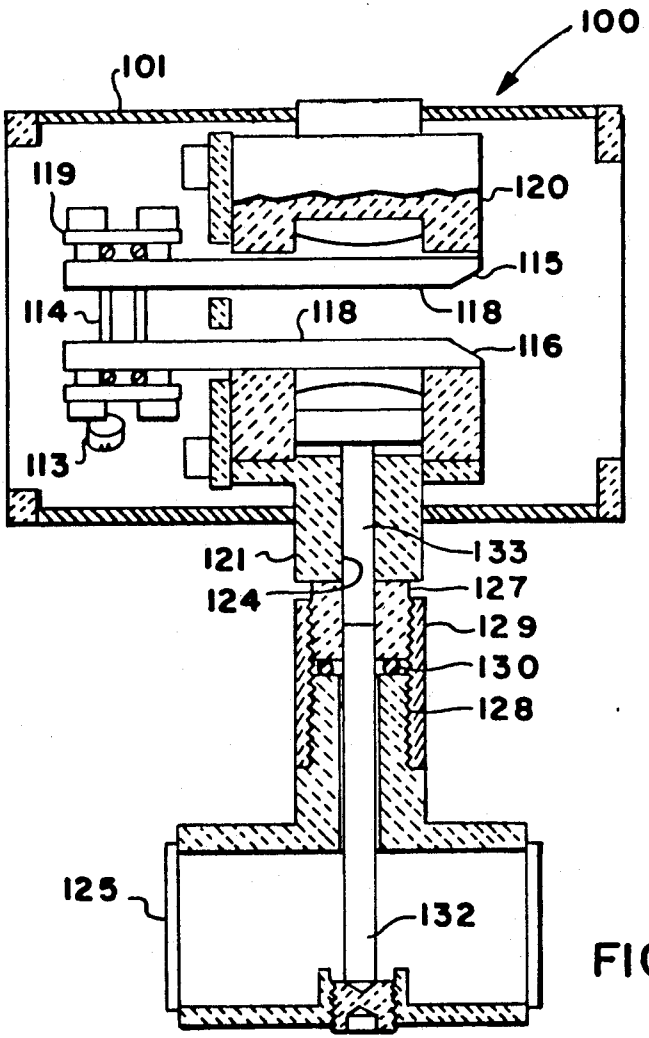
FIG. 5 is an elevation view of the interlock vacuum sealed enclosure which is also shown in FIG. 4.
Figure 6:
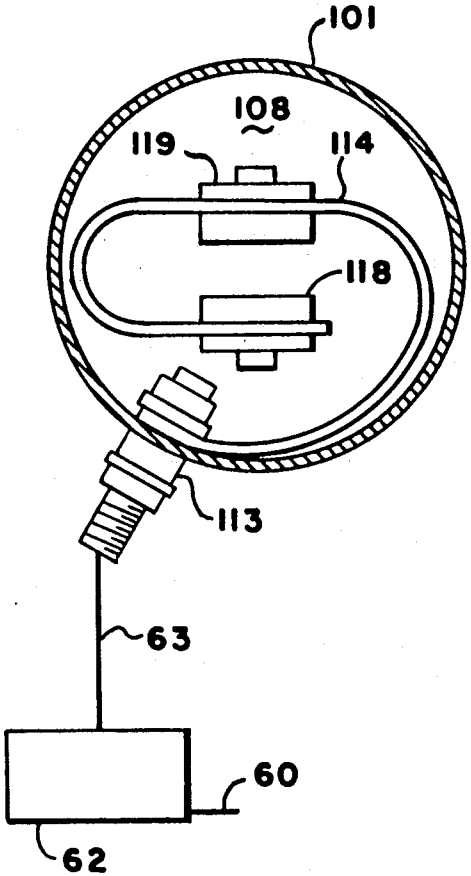
FIG. 6 is a front side elevation view of a portion of the enclosure shown in FIG. 5.

As best shown in FIG. 6, power feed electrode 63 sealingly extends into chamber 108 by means of sealed fastener 113 threaded through an opening in casing 101. Crimped by fastener 113 is a copper wire 114. Copper wire 114 in turn is fastened to first and second generally flat contact plates 115, 116 thus establishing permanent electrical contact between power feed electrode 63 and contact plates 115, 116. Each contact plate 115, 116 has a flat contact surface 118 on one side thereof adapted to contact blade 112 and on its opposite side a spring support surface 119. Adjacent spring support surface 119 of first contact member 115 is a fixed first spring support 120 welded to casing 101. Adjacent spring support surface 119 of second contact plate 116 is a second fixed spring support 121 welded to casing 101. As best shown in FIG. 7, each flat contact surface 118 has a spring seat formed therein for receiving a compression spring 123, there being two such springs 123 in the arrangement disclosed. Springs 123 bias first contact plate 115 over spherical washers 120*a* against first spring support 120 and second contact plate 116 against second support 121 to define a gap therebetween which is larger than the thickness of blade 112 so that normally no electrical contact occurs between power feed electrode 63 and blade 112.

Within second spring support 121 is a central plunger opening 124. This central plunger opening 124 is placed in fluid communication with the interior of a bellows 125. Fluid communication is established by a threaded collar 127 formed at the end of second spring support 121 abutting a similarly threaded bellows collar 128 formed at the end of bellows 125. A threaded sleeve 129 connects spring support collar 127 with bellows collar 128 and when tightened, compresses an O-ring 130, to maintain a vacuum seal between plunger opening 124 and the interior of bellows 125. Thus, bellows 125 is physically situated outside of interlock housing 100 and is subjected to atmospheric pressure while the interior of bellows 125 is in fluid communication with interlock housing chamber 108. When a vacuum is drawn in interlock housing chamber 108, bellows 125, because of the differential pressure between its interior and exterior, will collapse. Accordingly, a push rod arrangement shown in the drawings as comprising a bellows rod 132 in contact with a spring support rod 133 will force first and second contact plates 115, 116 into contact with blade 112 against the bias of spring 123 when vacuum distends bellows 125 into a collapsed position. When vacuum is not present, compression springs 123 will force contact plates 115, 116 away from blade 112. In theory, electrical contact can be solely controlled by vacuum. In practice, the contact gap is such that when the door is closed, incidental contact can occur. That is, the closing of the door is the act which can establish electrical contact and the motion of the door as described above is important in this regard. When a vacuum is drawn, bellows 125 establishes a very high clamp force preventing any movement between plates 115, 116 and blade 112. This assures a mechanically positive electrical interlock connection between power feed electrode 63 and contact rod 72 whenever the door is closed and vacuum is drawn. Importantly, because contact plates 115, 116, by clamping blade 112, establish a rigid (almost a pinned) contact with blade 112, contact rod 72 can move relative to the vacuum chamber and load support 65 without breaking or deteriorating the electrical contact.

Housing 100 is directly connected to the power supply and housing 100 and bellows 125 are electrically active when power is applied. On the outside of door 25 an interlock box 68 is constructed to surround interlock housing 100 and bellows 125 to prevent direct contact by the operator therewith. A fan 135 mounted to interlock box 68 causes air to flow through box 68 cooling interlock housing 100 but more importantly maintaining the exterior surfaces of interlock box 68 cool to the touch.

As noted previously, when shell member 23 is heated, it will distort and to maintain contact rod 72 and second tube 71 in proper attitudinal alignment within first tube 70, first and second V-shaped diametrically opposed longitudinally spaced pulleys 136, 137 as best shown in FIG. 2 are provided. Pulleys 136, 137 are adjustable by conventional means and allow contact rod 72 to expand and not distort or bind within second tube 71 and move freely with respect to load support 65 to which it is electrically connected by electrically conductive strap 74. Importantly, first pulley 136 maintains second tube 71 properly positioned within first tube 70 notwithstanding the thermal distortion or movement of shell 23. Contact rod 72 is longitudinally fixed within heat chamber 47 by means of a positioning sleeve 139 which receives the rearmost end of contact tube 72. Positioning sleeve 139 (schematically shown in FIGS. 2 and 3) has a plurality of longitudinally spaced locating holes drilled therethrough and adjacent the rearmost end of contact tube 72 is at least one hole extending therethrough so that by moving contact rod 72 the longitudinal position of contact rod 72 can be fixed by inserting a pin as shown at 140 to extend through the holes in contact tube 72 and positioning sleeve 139. Positioning sleeve 139 with a retainer or stop 142 is held between roller 137 and abuts against a lever 145 pivotable at 146 about hearth 65 and counterweighted at 147. When contact rod 72 expands faster than shell 39, counterweight 147 is pivoted or forced up by lever 145. When contact rod 72 remains thermally expanded longer than shell 39, retainer or stop 142 approaches roller 137 and proper length adjustment of contact rod 72 with sleeve 139 vis-a-vis pin 140 is required to compensate. Thus, the longitudinal position of contact rod 72 is established by the pin connection 140 relative to a stop 143 associated with contact plates 115 and 116 and stop 142 associated with positioning sleeve 139. Height adjustment of contact rod 72 is determined by the adjustments made in V-shaped pulleys 136, 137. Preferably, contact rod 72 or more specifically second support tube 71 is located offset from the center of first tube 70 and in fact is adjusted slightly downward from the center of tube 70 because of the manner in which shell member 23 distorts.

Figures 8A, 8B, 9, 10, 11, 12, 13, 14, 15, 16:
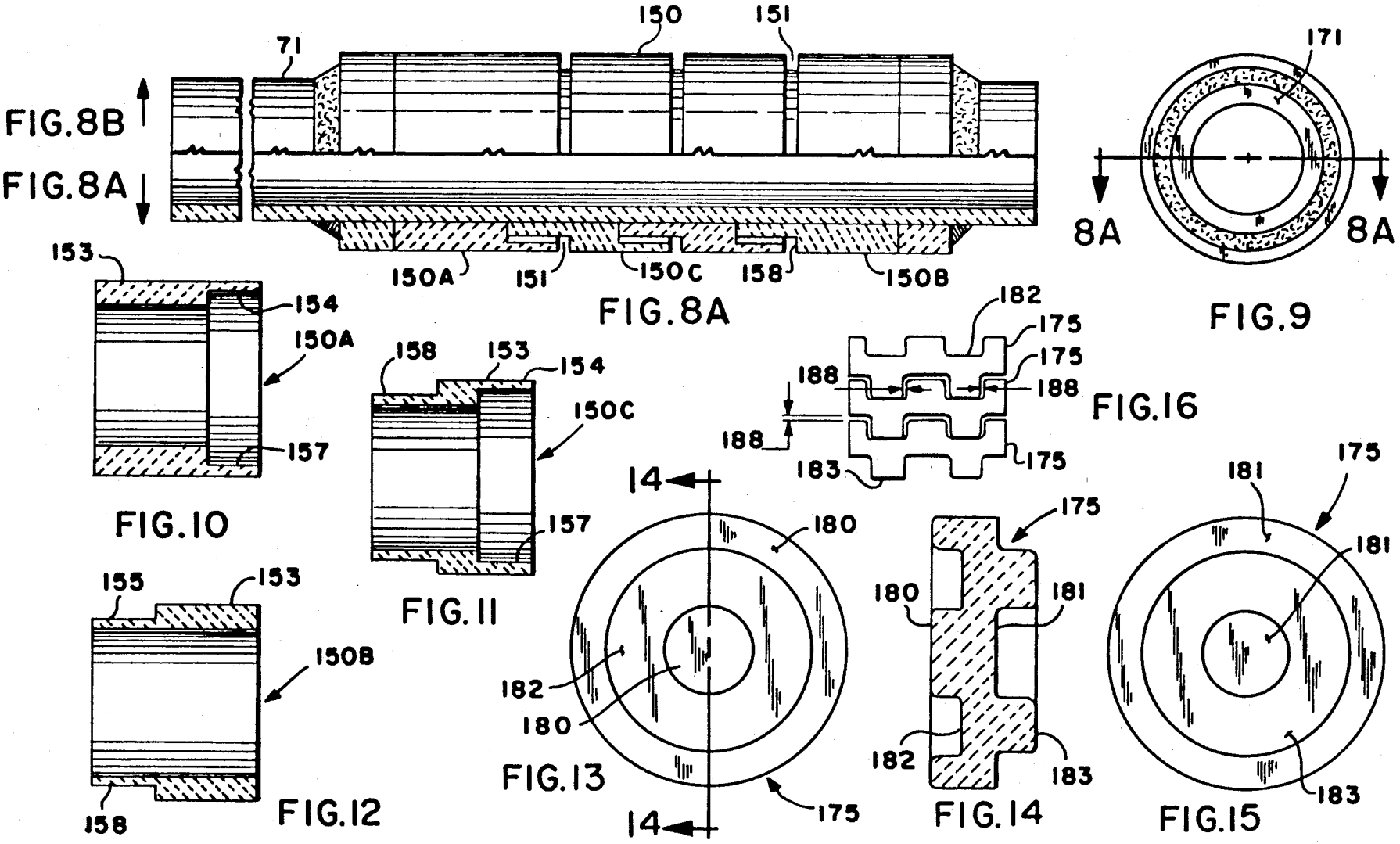
FIG. 9 is an end view of the tube shown in FIG. 8.
FIGS. 10, 11 and 12 are side views of insulator spacers which make up the rear portion of the tube shown in FIG. 8.
FIG. 13 is a top view of a hearth spacer.
FIG. 14 is a cross-sectional view of the spacer shown in FIG. 13 through the center of the spacer.
FIG. 15 is a bottom view of the spacer shown in FIGS. 13 and 14.
FIG. 16 is a plan assembly view of several of the spacers shown in FIGS. 13–15 stacked one on top of the other.

Second tube 71 is shown in FIGS. 8 through 12. A special configuration at the rearward end of tube 71 was developed to fit over the rear portion of tube 71 to prevent electrically conductive material from being deposited on the exterior of tube 71 which conceivably could establish a glow discharge from electrode 74 to tube 71 all the way into interlock box 68 if second tube 71 was straight even through the length of first tube 70 is about 18" and the length of second tube 71 is about 36". To prevent the glow discharge or sparking or arcing occurring about second tube 71, the rearward end of second tube 71 receives a plurality of ceramic spacers 150 interlockingly stacked to one another as best shown in FIG. 8. More specifically, the end portion of second tube 71 in heat chamber 47 includes a plurality of interlocking insulator ring caps 150 fitting within one another while over the rear end of tube 71 to prevent sparking, arcing or glow discharge at the end of second tube 71 by tortuous paths diagrammatically illustrated at 151 established between adjacent caps 150 to prevent buildup of electrically conducted deposits thereon. The ring cap slipover assembly shown in FIG. 8 includes a pair of end caps 150*a*, 150*b* and a plurality of intermediate caps 150*c*.

Each intermediate cap 150*c* has a cylindrically stepped body portion 153 with a forward end portion 154 and a rearward end portion 155. The forward end portion 154 has an inside cylindrical surface 157 of a first diameter and the rearward end portion 155 has an outside cylindrical surface 158 of a diameter smaller than the diameter of inside cylindrical surface 157. Furthermore, the outside diameter of body portion 153 is equal to the outside diameter of forward portion 154. The leading end cap 150*a* is shaped with a forward end 154 identical to the forward end 154 of intermediate cap 150*c*. The trailing end cap 150*b* is shaped with a rearward end 155 identical to the rearward end 155 of intermediate cap 150*c*. By forming the rear end portion of second tube 71 in this manner, the number of insulating caps 150 can vary from one furnace application to another depending on the service application.

Referring next to FIGS. 2 and 3, floating hearth 65 includes a frame comprising first and second longitudinally extending rails 170, 171 which support work in baskets or trays (not shown) placed thereon. Rails 170, 171 are laterally spaced from one another and interconnected by cross member 172. Positioned underneath and at each end of rails 170, 171 is a flat box or cradles 173, there being four such boxes 173 for hearth 65. Each box 173 is a box shaped fabrication and includes on one end of hearth 65 a separate pad 174 having a curved bottom surface in contact with lower box 173 to permit relative movement between pad 174 and box 173. Boxes 173 can be interconnected by cross members and are supported from shell member 23. Rails 170, 171 are supported by a plurality of interlocking ceramic spacers 175 stacked one on top of the other to form columns extending between the underside of rails 170, 171 and cradle 173. A top pad 176 similar in function to pad 174 can be provided between the top most spacer 175 and rail 170, 171. When shell 23 distorts pads 174 and optionally pads 176 will shift and some movement between adjacent spacer 175 will occur to maintain spacers 175 in columnar alignment and keep rails 170, 171 in proper attitudinal alignment so that the work is maintained on hearth 65.

Hearth 65 can thus float relative to shell member 23. The work is kept more or less level during the ion processing and ion geometry or the glow established from ion bombardment does not shift during heating. Flotation is not possible if rails 170, 171 were pinned by fixed tubes to cradles 173 in accordance with conventional practice because of binding which would otherwise occur.

Spacers 175 are formed of electrically non-conductive material having a low dielectric constant such as conventional ceramic materials and are shown in FIGS. 13-15. Each spacer 175 is a circular disc having a top surface 180 shown in FIG. 13 and a bottom surface 181 shown in FIG. 15. Top surface 180 has an annular groove 182 of a predetermined radial width formed therein. Bottom surface 181 has an annular protrusion 183 of predetermined radial width extending therefrom. As best shown in FIG. 14, groove 182 and protrusion 183 are aligned with one another and groove 182 has a slightly larger radial width than protrusion 183. Additionally, the depth of groove 812 is slightly less than the axial distance protrusion 183 extends from the face of spacers 175. As best shown in FIG. 16, spacers 175 are stacked in a columnar manner one on top of the other by protrusion 183 of one spacer 175 fitting into groove 182 of an adjacent spacer 175. The dimensional differences between groove 182 and protrusion 183 is such that a trotuous gap indicated by arrows 188 is provided. Gaps 188 thus provide two functions. First, they prevent electrically conductive material from being accumulated to the point where electrical contact between frame rails 170, 171 and shell member 23 exists. Second, the dimensional differences permit some degree of relative movement between spacers 175 permitting shell member 23 to yew, yaw or skew while maintaining hearth rails 170, 171 relative steady. Further, the height of the hearth frame can be adjusted by the number of spacers 175 provided. Adjustment can also be made by the number of spacers between adjacent columns. That is, if shell member 23 was consistently distorted in a downward direction, spacer column height could be varied to account for the distortion.

The invention has been described with reference to a preferred embodiment. Obviously, modifications and alterations will occur to those skilled in the art upon reading the understanding the invention. It is intended to include all such modifications and alterations insofar as they come within the scope of the present invention.

Having thus defined the invention, it is claimed:

1. A feed-through interlock apparatus for an industrial vacuum furnace capable of ion processing of work therein, said furnace including a vacuum vessel having an opening sealingly closed by a door mounted thereto to define a heat chamber therein and a hearth for supporting the work in said chamber, said apparatus comprising:

an interlock box affixed to said door and defining a sealed interlock enclosure therein, an opening through said door in fluid communication with said sealed interlock enclosure whereby said sealed interlock enclosure is in fluid communication with said heat chamber when said door is closed;

elongated tubular means within said heat chamber for shieldably containing an electrical conductive contact rod, said tubular means adapted to extend within said door opening and said contact rod adapted to extend within said interlock enclosure when said door is closed; said contact rod having a bayonet contact at its end within said interlock enclosure and means within said heat chamber extending from said contact rod to said hearth to establish an electrical connection between said hearth and said contact rod;

an electrical power feed contact means sealingly extending within said interlock enclosure for supplying electrical power to said hearth and bellow means in fluid communication with said interlock enclosure for establishing a clamp pinning said power feed means to said bayonet contact when a vacuum is drawn in said heat chamber whereby said contact rod is free to move only at its end within said heat chamber.

2. The apparatus of claim 1 further including diametrically opposed first and second V-shaped pulleys fixed to said vessel in said heat chamber for maintaining said contact rod centered relative to said contact means while permitting said contact rod to move along its elongated axis when said rod thermally expands during heating of said work.

3. The apparatus of claim 1 wherein said electrical power feed contact means includes a power feed electrode, first and second longitudinally extending contact plates generally parallel to one another, spring means for biasing said contact plates away from one another to define a contact gap therebetween, said power feed electrode secured to at least one of said contact plates, said bayonet contact adapted to extend within said contact gap when said door is closed; and said bellow means includes a push rod operatively connected to said spring means and a bellows for moving said push rod and in fluid communication with said interlock enclosure such that in response to a negative pressure within said interlock enclosure said bellows causes said push rod to overcome a bias of said spring means and clamp said bayonet contact between said contact plates.

4. The apparatus of claim 3 wherein said bayonet contact has a generally flat blade adapted to extend between said contact plates such that said blade is firmly pinned to said contact plates when said bellows means causes said contact plates to clamp said blade whereby said contact rod is firmly fixed to said electrical power feed contact means.

5. The apparatus of claim 4 wherein each contact plate has a flat contact surface on one side thereof and a spring support surface on its opposite side, said spring means includes a first fixed spring support adjacent said spring support surface of said first contact plate, a second fixed spring support adjacent said spring support surface of said second contact plate, laterally spaced spring seats formed in said contact surfaces of said contact plates, and at least one compression spring between said spring seats biasing said second contact plate into contact with said second spring support and said first contact plate into contact with said first spring support.

6. The apparatus of claim 5 wherein said first spring support extends from said interlock enclosure and has a plunger opening extending therethrough, said bellows sealably secured to said first spring support, said push rod slidably received within said plunger opening and adapted to contact said spring support surface of said first contact plate when said bellows contacts to overcome the bias of said spring and force said contact surface of said first and second contact plates into contact with said blade of said bayonet.

7. The apparatus of claim 1 wherein said interlock box includes a box surrounding and containing a vacuum sealed housing and defining a closed air space thereabout, said vacuum sealed housing containing said sealed interlock enclosure; said box mounted to said door and having an air inlet, an air outlet and fan means for causing air to flow from said inlet to said outlet for cooling said vacuum sealed housing therein.

8. The apparatus of claim 2 wherein said tubular means includes a first electrically non-conductive tube mounted within and extending through said door, a second smaller diameter electrically non-conductive tube within said heat chamber and having a portion thereof adapted to extend within said first tube when said door is closed, said electrically conductive contact rod having a portion thereof extending through said second tube whereby said second tube shields said contact rod disposed therein.

9. The apparatus of claim 8 wherein the end portion of said second tube in said heat chamber includes a plurality of interlocking insulator caps fitting within one another and over said second tube to prevent sparking, arcing and glow discharge at said tube end portion by tortuous paths established between said caps to prevent buildup of electrically conductive deposits thereon.

10. The apparatus of claim 9 wherein each insulator cap has a cylindrically stepped body portion with a forward end portion and a rearward end portion, said forward end portion having an inside cylindrical surface of a first diameter and said rearward end portion having an outside cylindrical surface of a second diameter slightly less than said first diameter and said body portion having an outside surface of a third diameter, said third diameter outside surface continuing to and including said forward end portion, said end portion of said second tube receiving a plurality of insulator caps with said rearward end portion of one insulator cap inserted into said forward end portion of an adjacent insulator cap to define a tortuous gap between adjacent body portions and between said second and said first diameter surfaces of adjacent caps.

11. An industrial vacuum furnace for heat treating metal workpieces by ion processing techniques, said furnace comprising:

a cylindrical vacuum-sustaining vessel defining a heat chamber therein, a hearth positioned in said heat chamber and a sealable door at one end of said vessel for loading and unloading said workpieces onto and off from said hearth;

a ground electrode secured to said vessel and an electrical power supply so that said vessel functions as an anode in the ion process;

an elongated contact rod within said heat chamber and extending through an opening in said door when said door is closed, means for electrically connecting said contact rod with said hearth so that said workpieces on said hearth function as the cathode in the ion process;

a box covering said door opening and defining a vacuum sealed enclosure therein, said contact rod extending within and through said opening and into said sealed enclosure when said door is closed;

a power electrode secured to said power supply and sealably extending within said interlock enclosure, and means associated with said interlock enclosure to clamp said power electrode and said contact rod together when a vacuum is drawn in said heat chamber whereby said contact rod is integrally energized with and by said power electrode.

12. The furnace of claim 11 further including elongated tubular means surrounding said contact rod for shielding said rod against electrical conductivity with the atmosphere in said heat chamber, said contact rod having a bayonet end portion extending within said interlock enclosure and beyond said tubular means when said door is closed, and said means for establishing electrical connection including bellow means in fluid communication with said interlock enclosure and activated by the pressure within said heat chamber for effecting said electrical connection.

13. The furnace of claim 11 wherein said vessel includes a thin imperforate, cylindrical shell having a generally spherical closed axial end and an open end sealably closed by said door and insulation means spaced from said shell;

said hearth includes a frame having a pair of laterally spaced, longitudinally extending load bearing rails, a pair of longitudinally spaced load bearing cradle positioned underneath each load bearing rail and resting on the interior of said shell member;

a column formed of a plurality of column spacers extending from each cradle to a load bearing rail and suspending said frame within said shell member;

each spacer interlocked with an adjacent spacer to define a tortuous space therebetween while permitting relative movement therebetween whereby distortion of said shell member during heating is compensated by relative movement of said column spacer.

14. The furnace of claim 13 wherein said column spacers are formed of electrically non-conductive material whereby said frame is insulated from said shell member.

15. The furnace of claim 14 wherein each column spacer is a circular disc having a top surface and a bottom surface, said top surface having an annular groove of a predetermined radial width formed therein, said bottom surface having an annular protrusion extending therefrom, said protrusion aligned with said groove and slightly less in radial width whereby said discs are stacked one on top of the other by said protrusion fitting within said groove to define said tortuous path between adjacent spacers preventing deposition of electrically conductive materials in quantities which permit arcing or glow discharge to occur.

16. The furnace of claim 15 further including a pad positioned between each load bearing cradle and said spacer column, said pad having an arcuate surface portion in contact with cradle whereby said spacers are generally maintained in columnar alignment when said shell member distorts under thermal expansion and contraction.

17. The furnace of claim 13 further including diametrically opposed first and second V-shaped pulleys fixed to said vessel in said heat chamber for maintaining said contact rod in predetermined position relative to said tube while permitting said contact rod to move along its elongated axis when said rod thermally expands during heating of said work.

18. The furnace of claim 13 wherein said electrical power feed contact means includes a power feed electrode, first and second longitudinally extending contact plates generally parallel to one another, spring means for biasing said contact plates away from one another to define a contact gap therebetween, said power feed electrode secured to at least one of said contact plates, said bayonet contact adapted to extend within said contact gap when said door is closed; and said bellow means includes a push rod operatively connected to said spring means and a bellows for moving said push rod and in fluid communication with said interlock enclosure such that in response to a negative pressure within said interlock enclosure said bellows causes said push rod to overcome said bias of said spring means and clamp said bayonet contact between said contact plates.

19. The furnace of claim 18 wherein said bayonet contact has a generally flat blade adapted to extend between said contact plates, said bellows means causes said contact plates to contact said blade whereby said contact rod can thermally expand while electrical contact between said contact plates and said tip is maintained; and each contact plate has a flat contact surface on one side thereof and a spring support surface on its opposite side, said spring means includes a first fixed spring support adjacent said spring support surface of said first contact plate, a second fixed spring support adjacent said spring support surface of said second contact plate, laterally spaced spring seats formed in said contact surfaces of said contact plates, and at least one compression spring between said spring seats biasing said second contact plate into contact with said second spring support and said first contact plate into contact with said first spring support.

20. The furnace of claim 18 further including door operating means for causing said door to initially rotate into an aligned position with said cylindrical shell and then move longitudinally into locked, sealing position with said open end of said shell.

21. An industrial vacuum furnace for heat treating metal workpieces by ionizing furnace atmosphere gases through an electrical potential established between said workpieces and the casing of said furnace, said furnace comprising:

a) electrical power means establish a source of electrical potential;

b) an imperforate thin walled cylindrical shell having a generally spherical closed axial end and an open end, a door for sealably closing said open end, and an electrode connected from said shell to said power means;

c) a hearth positioned in said shell, said hearth including a frame; electrical contact means for establish electrical contact between said frame and a second power feed electrode connected to said power means, said frame having a pair of laterally spaced, longitudinally extending rails, at least one cross member securing said rails together; a pair of longitudinally spaced cradles situated under each rail and resting on said shell and a plurality of interlocking insulating spacers stacked one on top of the other to form a column extending between each cradle and the underside of a rail for supporting said frame a spaced distance from said shell; and d) a pad positioned within each cradle between said column and said shell, said pad having an arcuate surface extending over at least a portion of its surface in contact with said shell whereby said column of said insulated spacers is maintained in general columnar alignment when said shell thermally distorts.

22. The furnace of claim 21 wherein said column spacers are formed of electrically non-conductive material whereby said frame is insulated from said shell member and each spacer is interlocked with an adjacent spacer to define a tortuous space therebetween while permitting relative movement between adjacent spacers so that said frame freely floats during thermal distortion of said shell.

23. The furnace of claim 22 wherein each column spacer is a circular disc having a top surface and a bottom surface, said top surface having an annular groove of a predetermined radial width formed therein, said bottom surface having an annular protrusion extending therefrom, said protrusion aligned with said groove and slightly less in radial width so that said spacers are stacked one on top of the other by said protrusion fitting within said groove to define discontinuous tortuous paths therebetween to prevent deposition of electrically conductive materials in quantities which permit arcing or glow discharge to occur.

* * * * *